US006051928A

United States Patent [19]

Choi et al.

[11] Patent Number: 6,051,928

[45] Date of Patent: Apr. 18, 2000

[54] PLASMA DISPLAY DEVICE WITH FERROELECTRIC DIELECTRIC LAYER

[75] Inventors: Kwi-seok Choi; Kyu-nam Joo; Su-chan Lee; Sang-jin Lee; Jong-seo Choi, all of Suwon, Rep. of Korea

[73] Assignee: Samsung Display Devices Co., Ltd., Kyungki-do, Rep. of Korea

[21] Appl. No.: 08/998,991

[22] Filed: Dec. 29, 1997

[30] Foreign Application Priority Data

Dec. 31, 1996 [KR] Rep. of Korea ..... 96-80161

[51] Int. Cl.[7] ..... H01J 17/49

[52] U.S. Cl. ..... 313/582; 313/586; 313/587; 313/584

[58] Field of Search ..... 313/582, 583, 313/584, 585, 586, 587, 495, 496, 292, 484, 485

[56] References Cited

U.S. PATENT DOCUMENTS 3,827,776 8/1974 Nakayama et al. ..... 313/587
4,562,434 12/1985 Amano ..... 340/775
5,124,615 6/1992 Kim ..... 313/586
5,717,291 2/1998 Kim ..... 313/582

*Primary Examiner*—Vip Patel
*Assistant Examiner*—Joseph Williams
*Attorney, Agent, or Firm*—Leydig, Voit & Mayer, Ltd.

[57] ABSTRACT

A plasma display panel includes front and rear substrates; anodes in a stripe pattern on a facing surface of the front substrate; a lower electrode coating the entire facing surface of the rear substrate; a dielectric layer coating the lower electrode; an upper electrode coating the dielectric layer in a pattern; and a lattice of partition walls between the upper electrode and the front substrate. The portions of the dielectric layer between the partition walls and not coated with the upper electrode form respective pixels. Sputtering is minimized and there is less damage to the electrodes by the gas, thus extending the length of use of the product. The ferroelectric material of the lower electrode has excellent resistance with respect to the discharge gas and the discharge can be initiated with a low initial discharge starting voltage since the ferroelectric cathode provides enough electrons for the discharge.

8 Claims, 4 Drawing Sheets

PLASMA DISPLAY DEVICE WITH FERROELECTRIC DIELECTRIC LAYER

BACKGROUND OF THE INVENTION

The present invention relates to a plasma display panel and, more particularly, to an improved plasma display panel which minimizes sputtering by employing a ferroelectric cathode.

The plasma display panel displays images using a gaseous discharge phenomenon. The plasma display panel is excellent in display capacity, brightness, contrast, viewing angle, etc., and is being touted as a display which can replace the cathode ray tube (CRT). In such a plasma display panel, a gas between electrodes emits ultraviolet rays when an AC or DC voltage is applied to the electrodes, thereby lighting a fluorescent material.

Plasma display panels can be divided into AC and DC types depending on the discharge mechanism. In the DC type plasma display panel, the respective electrodes which make up the plasma display panel are directly exposed to a gas layer sealed in a discharge cell. Thus the voltage applied to the electrodes is applied to the discharge gas layer as is.

In the AC type plasma display panel, the respective electrodes are separated from the discharge gas layer by a dielectric layer and charged particles generated during a gas discharge form wall charges without being absorbed by the electrodes. The following discharge occurs because of such wall charges.

FIGS. 1 and 2 show conventional AC type and DC type plasma display panels, respectively. Referring to FIG. 1, the AC type plasma display panel 10 comprises glass substrates 12 and 13 arranged parallel to each other, electrodes 14 and 15 on facing surfaces of the glass substrates 12 and 13, respectively, dielectric layers 15 and 16 covering the electrodes 14 and 15, respectively, and protective layers 17 and 18 on the surfaces of the dielectric layers 15 and 16, respectively. lo Referring to FIG. 2, the DC type plasma display panel 20 comprises glass substrates 21 and 22 parallel to each other and electrodes 23 and 24 on facing surfaces of the glass substrates 21 and directly exposed to the plasma gas.

The conventional plasma display panels having the above structure have a shortcoming in that an initial discharge starting voltage required for discharge is high. In particular, the DC type plasma display panel has problems in that the electrodes are damaged and a short-circuit may occur between the electrodes due to sputtering by gas ions since the electrodes are directly exposed to the gas.

SUMMARY OF THE INVENTION

To solve the above mentioned problems, it is an object of the present invention to provide a plasma display panel whose structure is improved to provide electrons for starting and maintaining discharge by employing a ferroelectric cathode.

To achieve the above object, there is provided a plasma display panel according to the present invention, comprising front and rear substrates formed of glass and separated from each other by a predetermined distance, a plurality of anodes formed in a stripe pattern on a facing surface of the front substrate, a lower electrode formed of an electrode material coated on the entire facing surface of the rear substrate, a dielectric layer formed of a dielectric material coated on the entire upper surface of the lower electrode, an upper electrode formed of the electrode material coated on the upper surface of the dielectric layer in a predetermined pattern, and lattice-type partition walls formed between the upper electrode and the front substrate, wherein the portions of the dielectric layer between the partition walls not coated with the upper electrode forms pixels.

The upper electrode is preferably formed in a stripe pattern so as to cross with the anodes.

An opening is formed in the upper electrode between the partition walls, thereby exposing portions of the dielectric layer through the opening.

Also, the dielectric layer is preferably made of a ferroelectric material formed of a metal oxide including Pb, Zr, and Ti or a metal oxide including Pb, Mn, and Nb.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
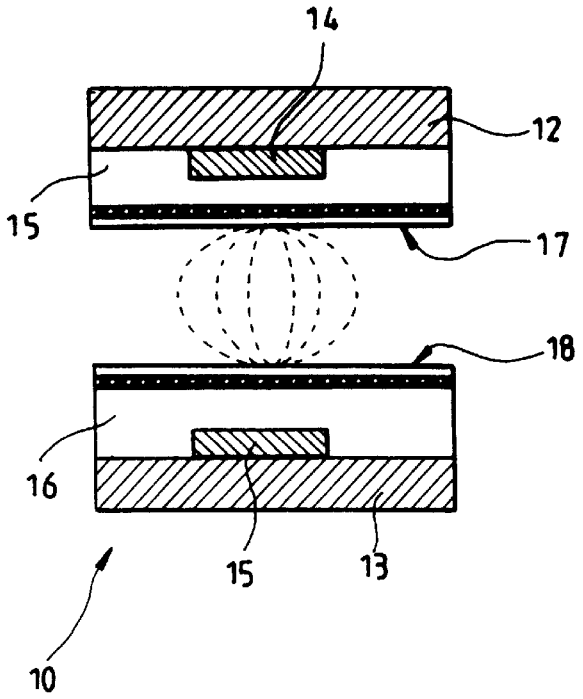
FIG. 1 (PRIOR ART)
FIG. 1 is a schematic sectional view of a conventional DC type plasma display panel.
Figure 2:
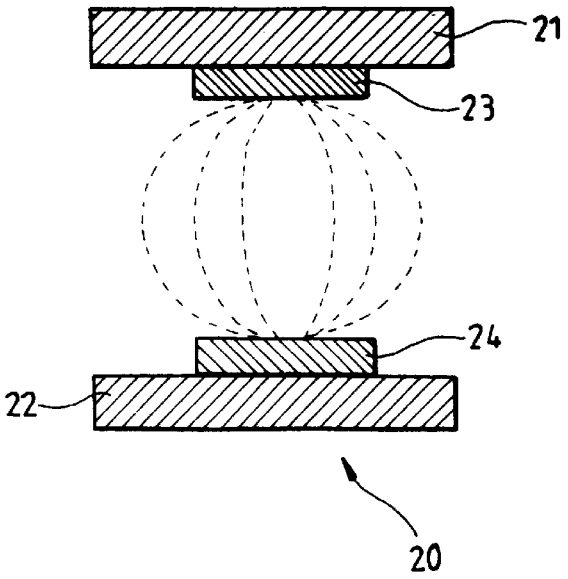
FIG. 2 (PRIOR ART)
FIG. 2 is a schematic sectional view of a conventional AC type plasma display panel.
Figure 3:
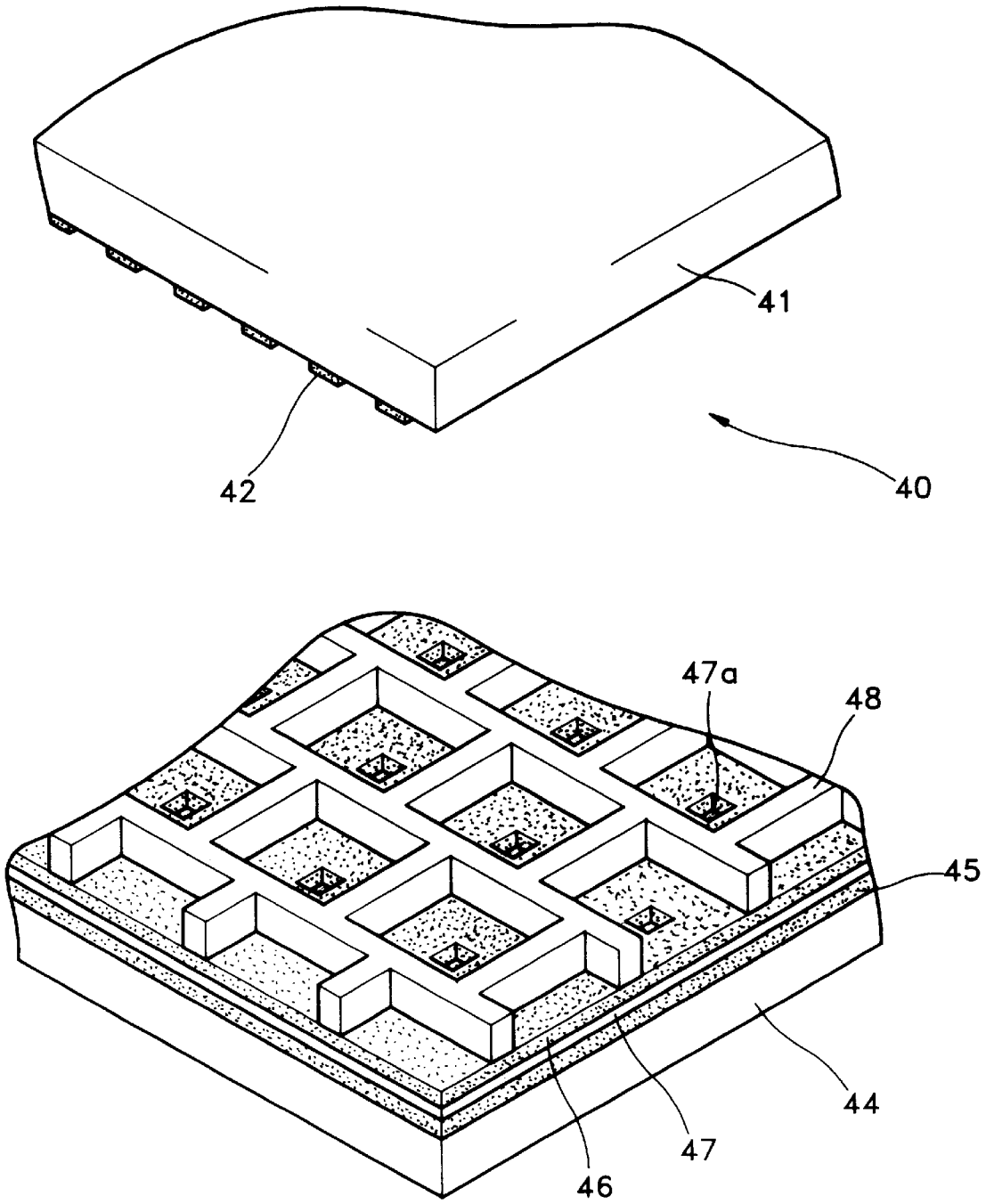
FIG. 3 is an exploded perspective view showing a plasma display panel according to an embodiment of the present invention.
Figure 4:
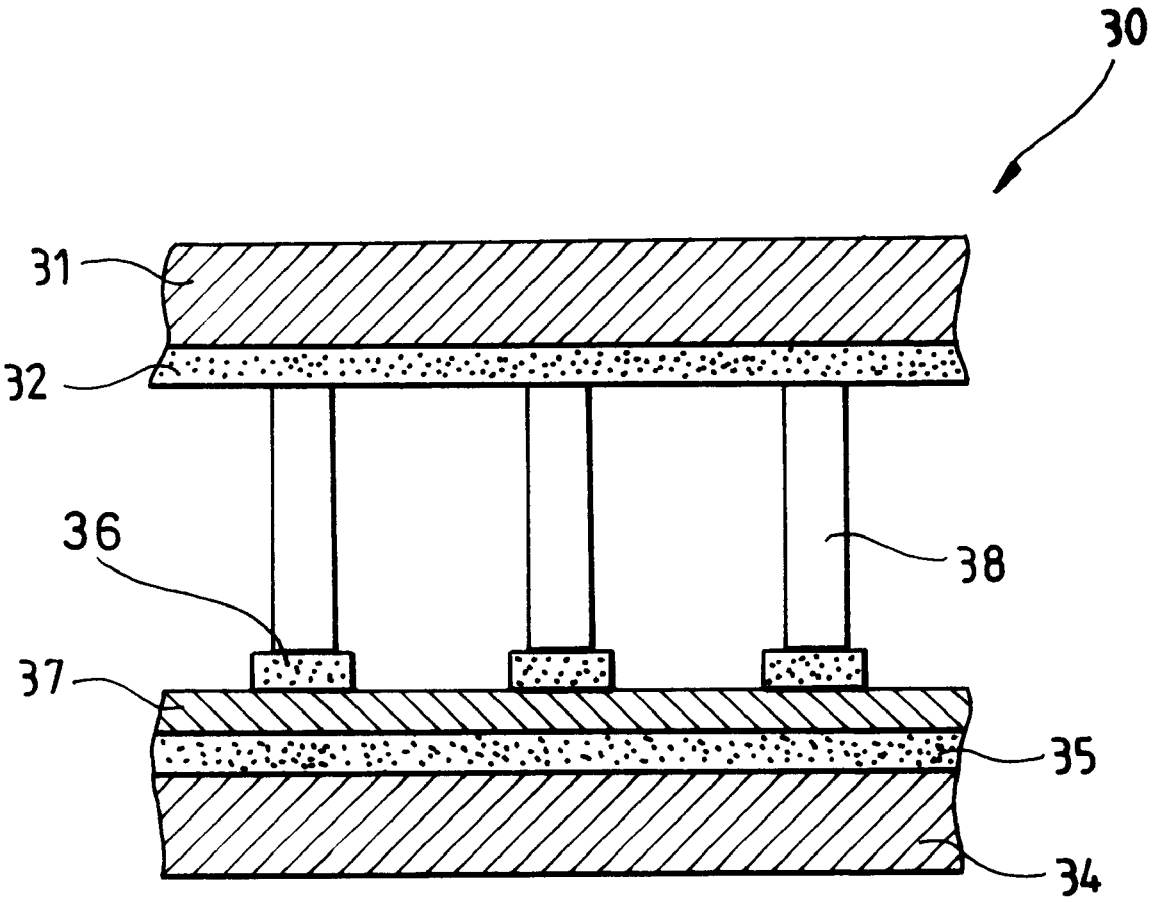
FIG. 4 is a sectional view of the plasma display panel shown in FIG. 3.

Referring to FIGS. 3 and 4, a plasma display panel 30 according to an embodiment of the present invention includes a front substrate 31 formed of glass and a rear substrate 34 separated from the front substrate 31 by a predetermined distance. A gas is sealed between the front substrate 31 and the rear substrate 34.

A plurality of anodes 32 are on the front substrate 31 in a unidirectional stripe pattern and a ferroelectric cathode for emitting electrons in response to a voltage pulse applied thereto is located on the rear substrate 34.

The ferroelectric cathode includes a lower electrode 35 formed of an electrode material coating on the entire upper surface of the rear substrate 34, a dielectric layer 37 formed of a dielectric material coating the entire upper surface of the lower electrode 35, and an upper electrode 36 formed of an electrode material and coating portions of the upper surface of the dielectric layer 37 in a stripe pattern crossing the anodes 32.

The dielectric layer 37, the upper electrode 36, and the lower electrode 35 are preferably coated by a screen printing method.

A metal oxide formed mainly of Pb, Zr, and Ti is preferably used as the ferroelectric material for forming the dielectric layer 37. Also, the ferroelectric material may be a metal oxide formed mainly of Pb, Mn, and Nb.

Reference numeral 38 denotes lattice-shaped partition walls for forming discharge cells. Some portions 37*a* of the dielectric layer 37 between the partition walls are exposed to a discharge gas, which forms a pixel.

The operation of the plasma display panel according to the embodiment of the present invention will be described with reference to FIGS. 3 and 4.

When a voltage pulse is applied to the upper and lower electrodes 36 and 35 respectively located on the upper and lower surfaces of the dielectric layer 37 of the plasma display panel 30, electrons are emitted from the dielectric material of the dielectric layer 37 and are accelerated, thus ionizing the gas between the front substrate 31 and the rear substrate 34. Respective fluorescent materials (not shown) are excited and emit light in response to the ultraviolet rays emitted by the ionized gas, thus forming an image.

Figure 5:
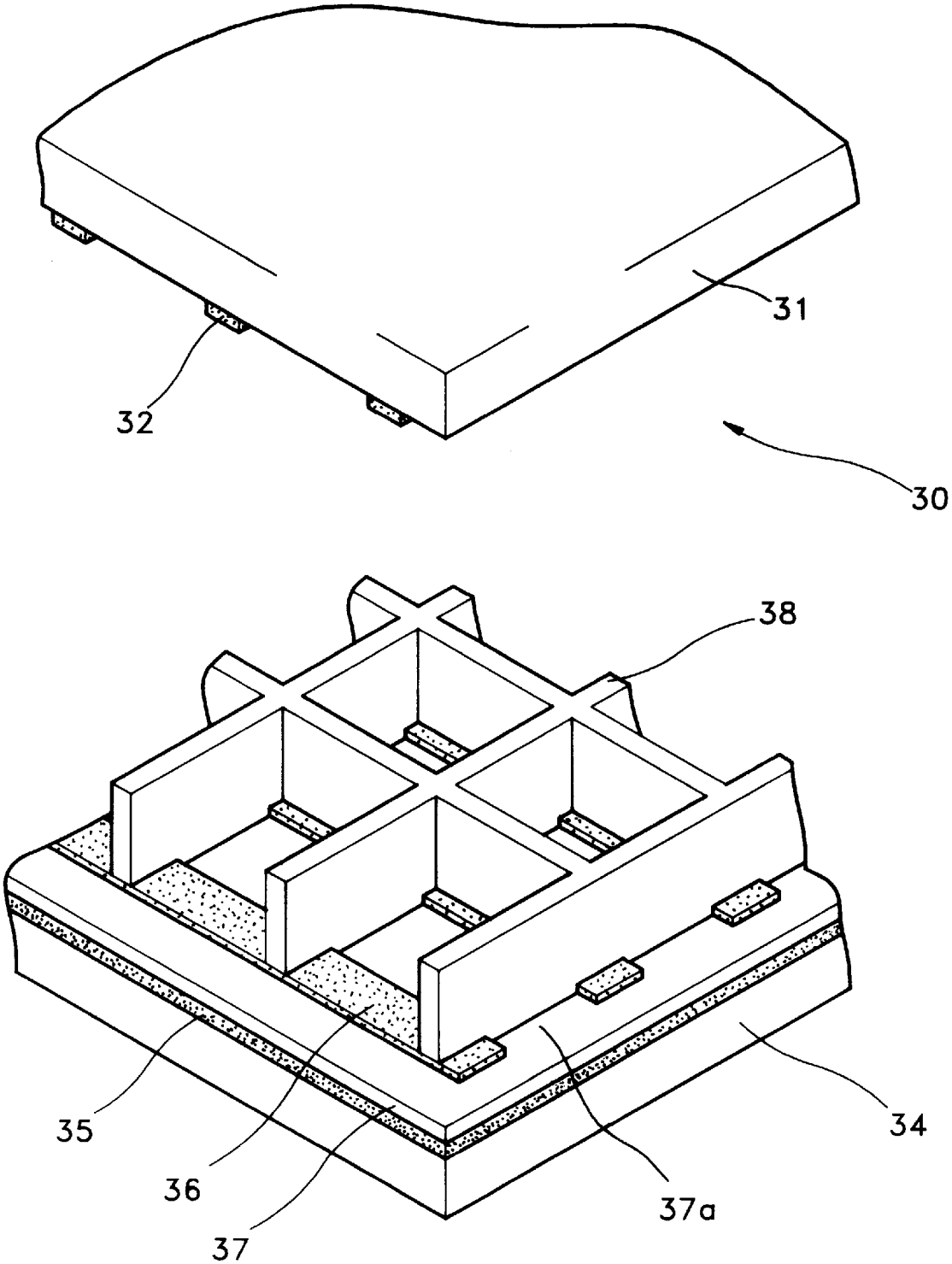
FIG. 5 is an exploded perspective view showing a plasma display panel according to another embodiment of the present invention.

FIG. 5 shows a plasma display panel according to another embodiment of the present invention. Referring to the drawing, a plasma display panel 40 according to this embodiment includes a front substrate 41 formed of glass and a rear substrate 44 separated from the front substrate 41 by a predetermined distance. A gas is sealed between the front substrate 41 and the rear substrate 44.

A plurality of anodes 42 are located on the front substrate 41 in a unidirectional stripe pattern and a ferroelectric cathode for emitting electrons is located on the rear substrate 44.

The ferroelectric cathode includes a lower electrode 45 of an electrode material coating the entire upper surface of the rear substrate 44, a dielectric layer 47 formed of a dielectric material on the entire upper surface of the lower electrode 45, and an upper electrode 46 formed of an electrode material on the upper surface of the dielectric layer 47. Lattice-type partition walls 48 for forming discharge cells are located on the upper electrode 46. Also, an opening 47*a* is located in the upper electrode 46 in each discharge cell between the partition walls, thereby partially exposing portions of the dielectric layer 47 under the upper electrode 46 to the discharge gas, which forms the pixels.

The operation of the plasma display panel according to the embodiment is the same as described for the other embodiment. Thus, the description will not be repeated.

The plasma display panel according to the present invention has the following advantages.

First, since the ferroelectric material which operates as the lower electrode has excellent resistance with respect to the discharge gas, the sputtering is minimized and there is less damage to the electrodes by the gas, thus extending the length of use of the product.

Second, since the ferroelectric cathode provides enough electrons for discharge, discharge can be achieved at a relatively low starting voltage.

The present invention has been described with reference to the embodiments shown in the drawings. However, the present invention is not restricted to the described embodiments and it is clearly understood that many variations may be made, within the scope and spirit of the present invention, by anyone skilled in the art.

What is claimed is:

1. A plasma display panel comprising:

front and rear substrates of class and separated from each other;

a plurality of anodes in a stripe pattern on a facing surface of said front substrate;

a lower electrode coating a facing surface of said rear substrate;

a dielectric layer coating said lower electrode, wherein said dielectric layer is a ferroelectric material including oxides of Pb, Zr, and Ti;

an upper electrode coating said dielectric layer in a pattern; and a lattice of partition walls between said upper electrode and said front substrate, wherein portions of said dielectric layer between said partition walls and not covered by said upper electrode form respective pixels.

2. The plasma display panel as claimed in claim 1, wherein said upper electrode has a stripe pattern crossing said anodes.

3. The plasma display panel as claimed in claim 1, including an opening in said upper electrode surrounded by said partition walls, exposing a portion of said dielectric layer.

4. The plasma display panel as claimed in claim 1, wherein said dielectric layer, said upper electrode, and said lower electrode are formed by screen printing.

5. A plasma display panel comprising:

front and rear substrates of glass and separated from each other;

a plurality of anodes in a stripe pattern on a facing surface of said front substrate;

a lower electrode coating a facing surface of said rear substrate;

a dielectric layer coating said lower electrode, wherein said dielectric layer is a ferroelectric material including oxides of Pb, Mn, and Nb;

an upper electrode coating said dielectric layer in a pattern; and a lattice of partition walls between said upper electrode and said front substrate, wherein portions of said dielectric layer between said partition walls and not covered by said upper electrode form respective pixels.

6. The plasma display panel as claimed in claim 5, wherein said upper electrode has a stripe pattern crossing said anodes.

7. The plasma display panel as claimed in claim 5, including an opening in said upper electrode surrounded by said partition walls, exposing a portion of said dielectric layer.

8. The plasma display panel as claimed in claim 5, wherein said dielectric layer, said upper electrode, and said lower electrode are formed by screen printing.

* * * * *